United States Patent [19]

Maezawa

[11] 4,280,207

[45] Jul. 21, 1981

[54] ELECTRONIC TIMEPIECE AND DIGITAL DISPLAY THEREFOR

[75] Inventor: Shuji Maezawa, Suwa, Japan

[73] Assignee: Kabushiki Kaisha Suwa Seikosha, Tokyo, Japan

[21] Appl. No.: 768,461

[22] Filed: Feb. 14, 1977

[30] Foreign Application Priority Data

Feb. 12, 1976 [JP] Japan ..... 51/14233

[51] Int. Cl.[3] ..... G04B 19/22

[52] U.S. Cl. ..... 368/21

[58] Field of Search ..... 58/4 R, 4 A, 23 R, 42.5, 58/43, 44, 50 R; 340/336; 368/21-24, 240

[56] References Cited

U.S. PATENT DOCUMENTS

| | | | |
|---|---|---|---|
| 1,046,246 | 12/1912 | Albrecht | 368/21 |
| 3,653,204 | 4/1972 | Miwa | 58/42.5 |
| 3,675,411 | 7/1972 | Sakuma | 58/42.5 |
| 3,918,251 | 11/1975 | Wakabayashi | 58/42.5 |
| 3,925,777 | 12/1975 | Clark | 340/336 |
| 3,940,920 | 3/1976 | Nakamura et al. | 58/42.5 |
| 3,953,963 | 5/1976 | Nishimura et al. | 58/23 R |
| 3,955,355 | 5/1976 | Luce | 58/50 R |
| 4,034,551 | 7/1977 | Ushiyama | 58/85.5 |
| 4,044,545 | 8/1977 | Shimuzu | 58/42.5 |
| 4,072,005 | 2/1978 | Teshima et al. | 58/42.5 |
| 4,123,896 | 11/1978 | Asano et al. | 368/22 |
| 4,133,170 | 1/1979 | Kashio | 368/21 |

*Primary Examiner*—Vit W. Miska

*Attorney, Agent, or Firm*—Blum, Kaplan, Friedman, Silberman & Beran

[57] ABSTRACT

An electronic timepiece including circuitry for automatically indexing the time counted thereby to represent the time at a different time zone, and a digital display that displays the particular time zone to which the time displayed by the timepiece has been indexed to, is provided. The indexing of the time displayed by the timepiece, is obtained by indexing circuitry disposed intermediate the hours counter of an electronic timepiece and the display driving circuitry. The indexing circuitry is adapted to selectively index the count of the time-keeping signals produced by the hours counter and thereby index the count of the timekeeping signal produced by the hours counter to a different time zone in response to each indexing thereof. In addition to display digits for numerically displaying time, further visual display segments are provided for indicating the particular time zone to which the numerical display has been indexed to.

22 Claims, 4 Drawing Figures

ELECTRONIC TIMEPIECE AND DIGITAL DISPLAY THEREFOR

BACKGROUND OF THE INVENTION

This invention is directed to an improved electronic timepiece and digital display therefor, and in particular, to an electronic timepiece having indexing circuitry for indexing the time displayed by the electronic timepiece to a particular time zone, and additional visual indication display segments for designating the particular time zone to which the numerical digital display has been indexed to.

Heretofore, electronic wristwatches capable of providing an indication of the time for each of the twenty four global time zones were mechanical or electromechanical hand display wristwatches. Such wristwatches were characterized by a circular scale representative of each of the global time zones with a location within each time zone being designated on the circular scale, in order to permit the wearer of the wristwatch to readily identify the particular time for that time zone. The circular scale carrying the time zone designated by the locality therein is manually rotated with respect to the hands display and provide a less than completely satisfactory global timepiece. Moreover, such rotatable scales cannot be utilized in digital display electronic timepieces since there is no hand display position that a rotatable scale can be oriented with respect to. Accordingly, a digital display electronic timepiece capable of displaying the time for each global time zone is provided.

SUMMARY OF THE INVENTION

Generally speaking, in accordance with the instant invention, an improved global electronic wristwatch and digital display therefor is provided. The electronic wristwatch includes divider circuitry for producing a low frequency timing signal and series-connected counters coupled to the divider circuitry, each of the series-connected counters being adapted to produce at least one timekeeping signal representative of the count there. A driver circuit is adapted to receive the timekeeping signals representative of the count of the counter producing same and, in response thereto, produce time display signals representative of the count of the timekeeping signals applied thereto. A digital display is adapted to receive time display signals and in response thereto, display time information corresponding to the count of the time display signals. The time displayed by the electronic timepiece is indexed to the global time zone desired by indexing circuitry disposed intermediate a predetermined timekeeping counter and the driver circuitry in order to selectively index the count of the timekeeping signal produced by the predetermined counter so that the count of the indexed timekeeping signal, applied to the driver circuitry, is changed by a predetermined count representative of a change in time zones.

A further feature of the instant invention is the global digital time display wherein numerical digits are utilized to display time, and a plurality of visual indication display segments representative of each time zone are utilized to visually indicate the particular time zone to which the numerical digits are indexed.

Accordingly, it is an object of the instant invention to provide an electronic wristwatch and digital display therefor that is capable of being indexed to display time representative of each of the global time zones.

Still a further object of the instant invention is to provide an improved digital display for displaying global time information.

Still another object of the instant invention is to provide improved electronic wristwatch circuitry for indexing the count of predetermined timekeeping signals produced by the hours counters in order to readily index same to represent the time at a different time zone.

Still a further object of the instant invention is to provide a simplified manually actuatable switch control for effecting indexing of the time zone displayed by the electronic timepiece.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
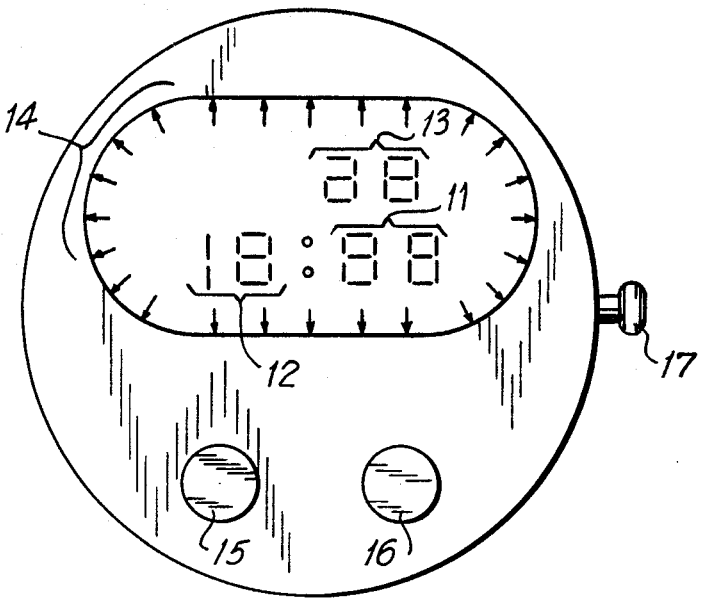
FIG. 1 is a plan view of a global electronic timepiece, and in particular, a digital display therefor, constructed in accordance with a preferred embodiment of the instant invention.

Reference is first made to FIG. 1, wherein a liquid crystal digital display global electronic wristwatch constructed in accordance with the instant invention is depicted. For purposes of illustration, each of the liquid crystal display segments, comprising the global digital display, are illustrated in FIG. 1.

Figure 3A:
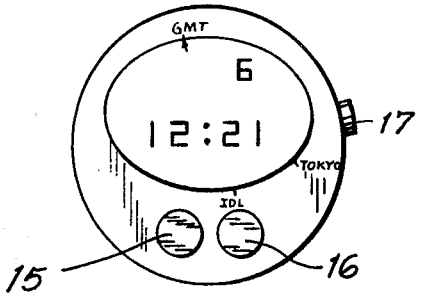
FIGS. 3A and 3B respectively illustrate the operation of the global display electronic wristwatch illustrated in FIG. 1.
Figure 3B:
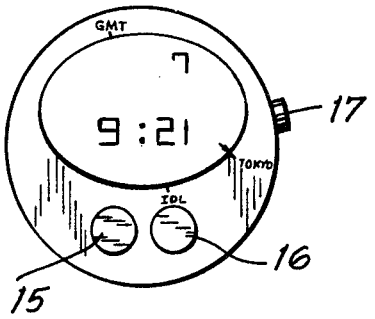

The global digital display is comprised of minutes digits 11, hours digits 12 and data digits 13. With the exception of the tens of date digits and the tens of hours digits, the remaining numerical digits, for displaying minutes, hours and the date, conform to a conventional seven-bar numerical display liquid crystal arrangement. Since the tens of date digit does not exceed three (3), and the tens of hours digit does not exceed one (1), a conventional seven-bar numerical configuration is not required. Additionally, the colon (:) between the minutes digits 11 and hours digits 12 can be formed from liquid crystal display segment electrodes or, alternatively, can be permanently formed on the face of the digital display. In order to effect a global display, twenty-four (24) visual indication display segments 14 are peripherally disposed around the numerical display digits, each of the respective visual display segments being representative of one of the twenty-four global time zones. As is illustrated in FIGS. 3A and 3B, printed adjacent to each of the further visual indication elements can be printed a particular locality or other designation identifying the particular time zone to which the visual indication segments refer. For example, in FIGS.

3A and 3B, the initials GMT are utilized to refer to Greenwich Mean Time, as a first time zone, the city of Tokyo is utilized to refer to a second time zone, and the initials IDL are utilized to refer to the International Date Line. As is explained in greater detail below, the global display wristwatch energizes one of said time zone visual display segments to illustrate the time zone corresponding to the time zone displayed by the numerical digits of the digital display. In order to obtain the time at a different time zone, the operator of the timepiece need only displace crown 17 to a time zone select position and thereafter actuate push button 15 or push button 16 on the face of the wristwatch. In response to actuating push button 15, the time zones will be indexed in a clockwise direction, one time zone for each pushing of push button 15, whereas each pushing of push button 16 will result in an indexing by one of each of the time zones in a counterclockwise direction. Moreover, when the crown 17 is in other than a time zone select position, the push buttons 15 and 16 are utilized as time correction switches in a manner to be discussed in greater detail below.

Figure 2:
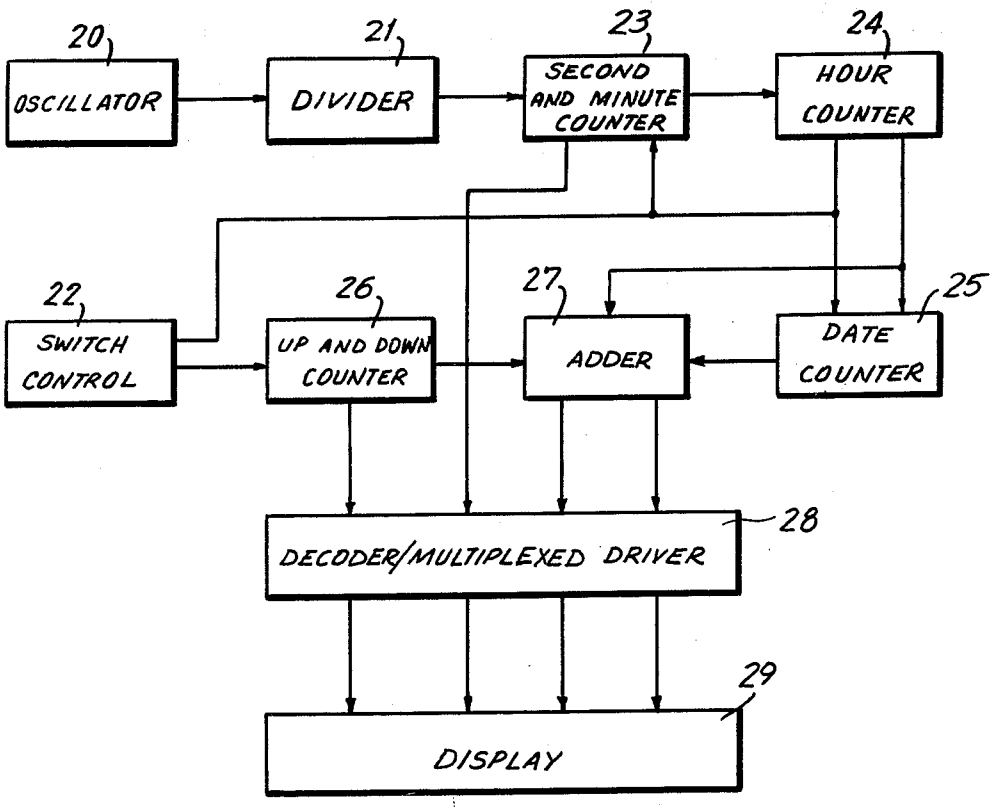
FIG. 2 is a block circuit diagram of the global display electronic wristwatch depicted in FIG. 1.

Reference is now made to FIG. 2, wherein the circuitry for indexing the global display, illustrated in FIG. 1, is depicted. The oscillator circuit 20, divider circuit 21, seconds and minutes counter 23, hours counter 24 and date counter 25 comprise conventional timekeeping circuitry.

For example, oscillator circuit 20 utilizes a quartz crystal vibrator as a high frequency time standard and applies to the divider circuit 21 a high frequency time standard signal having a frequency corresponding to the resonant frequency at which the quartz crystal time standard vibrates. The divider circuit 21 is comprised of a plurality of series-connected divider stages for dividing down the high frequency time standard signal produced by the oscillator circuit 20 to thereby produce a low frequency timing signal preferably having a period equal to one second or one minute, depending on whether or not the wristwatch is designed to display seconds. In the embodiment illustrated in FIG. 2, for a seconds and minutes counter 23, a one second low frequency timing signal is applied to the seconds and minutes counter, which counter, in response thereto, produces timekeeping signals representative of the count of the seconds and minutes counters. Similarly, hours counter 24 series connected to seconds and minutes counter 23, and date counter 25 series connected to hours counter 24, produce timekeeping signals representative of the respective hours and dates counted thereby. A decoder and multiplexing driver circuit 28 is provided for receiving timekeeping signals, and in response thereto applying the timekeeping signals to the digital display 29, which digital display is illustrated in FIG. 1, as described above in detail.

In order to effect indexing of the time displayed by the global wristwatch, in accordance with the instant invention, indexing circuitry, comprised of control switch 22, up and down counter 26 and adder circuit 27, are provided. The adder circuit 27 is disposed intermediate the hours counter and the driver circuit for receiving the timekeeping signal produced by the hours counter, indexing same, and applying the indexed signal to the decoder and driving circuitry 28. The adder is additionally disposed intermediate the date counter 25 and decoder and driving circuit 28, in order to index the count of the timekeeping signal produced by the date counter, when necessary, before applying same to the decoding and driving circuitry 28. The indexing of the count of the timekeeping signals applied to the adder circuit 27 is controlled by up and down counter 26, which counter controls whether the adder circuit adds a count of one to some or all of the timekeeping signals applied to the adder circuit or, alternatively, removes a pulse from the timekeeping signals applied to the adder circuit 27. Additionally, up and down counter 26 produces an indexing signal, which signal is applied to the decoding and driving circuitry 28 to thereby select the global visual display segment 14 to be energized. The up and down counter 26 is controlled by control switch circuitry 22, which circuitry includes push button switches 15 and 16 and crown 17.

The switching control circuit 22 is further coupled to the seconds and minutes counter 23, hours counter 24 and date counter 25, to effect correction of the time displayed thereby in a conventional manner. Specifically, when crown 17 is disposed in a first correction position, each pushing of push button 15 effects a sequential selection of one of the counters in a sequential order. For example, when crown 17 is displaced to a time correction position, a particular counter will be selected for correction. One prior art arrangement provides for the counter to be corrected to be flickered in order to illustrate to a person doing the correcting which counter is to be indexed. Accordingly, if the seconds and minute counter is flickered in response to a positioning of the crown 17 at a correction position, each pushing of the push button 16 will effect an indexing by one of the count of the minutes counter. Thereafter, if correction of the hours counter is desired, a pushing of push button 15 will result in the hours counter being selected for correction, whereby the hours digits will be flickered, and thereafter, each pushing of push button 16 will result in an indexing of the count of the hours counter by one. A further pushing of push button 15 will result in a selection of the date counter 25, after which the seconds and minutes counter 23 will thereafter be sequentially selected. Moreover, if the digital display provides for the display of seconds, upon returning the crown from the correction position, the seconds display will be reset to zero seconds in order to effect correction of the seconds display once each of the time display digits have also been corrected. However, once the crown 17 is displaced to a global indexing position, the push buttons 15 and 16 will effect indexing of the digital display and not correction of the count of the respective timekeeping counters. Accordingly, the same switches utilized to effect time correction, can be utilized to effect global indexing to thereby avoid the necessity of adding further switches to the electronic timepiece.

In order to understand the operation of the instant invention, reference is made to FIGS. 3A and 3B, wherein a change in the display of time at the time zone for Greenwich Mean Time to Tokyo time is depicted. If the global display is illustrating Greenwich Mean Time, and in particular, that it is the sixth (6th) day of the month, and the time is twenty-one minutes after twelve (12:21), and the person wearing the wristwatch wishes to determine the date and time at that same moment in Tokyo, Japan, indexing to a different global time zone is effected in the following manner.

First, the crown 17 is displaced to a global select position. Thereafter, the person effecting indexing of the time zone can look at the different localities and/or time zone designations and determine whether the time zone to be selected will be reached faster by being indexed in a clockwise manner around the numerical display digits, or alternatively, if indexing in a counterclockwise direction around the display digits will reach the desired time zone sooner. To this end, pushing of push button 15 will effect indexing by one in a clockwise direction, whereas pushing of push button 16 will effect indexing by one in a counterclockwise direction. As illustrated in FIG. 3A, Tokyo would appear to be closer to Greenwich Mean Time if indexing is effected in a clockwise direction, and accordingly, push button 15 is selected to effect the indexing operation. In response to each pushing of push button 15, switch control circuit 22 applies an indexing pulse to the up and down counter 26, which counter, if a clockwise direction is selected, counts up by one in response to each actuation of push button 15. Counting by one (1) by up and down counter 15, effects, in turn, the application of an indexing signal to the decoder and driver circuitry 28 to change the visual display segment being energized to the global visual display segment adjacent, in a clockwise direction, the previously energized display segment. Moreover, each further pushing of push button 15 will effect a further changing, in a clockwise direction, of the visual display segment being energized until the visual display segment 14, corresponding to Tokyo, is energized.

In addition to indexing the global visual display segments 14, in a clockwise direction, in response to each actuation of push button 15, up and down counter 26 applies an add by one signal to the adder 27, to thereby effect an adding of a count of one to the hours timekeeping signal, and if necessary, the date timekeeping signal, in response to each indexing signal applied to the up and down counter 26. Since a change in time zone usually requires only a change in the hours display, and occasionally a change in the date display, it is only necessary to modify the count of the timekeeping signals produced by the hours counter, and only, if necessary, the timekeeping signal produced by the date counter. For example, if a single time zone change is required, it is only necessary to index the count of the hours display by one (1). Assuming that the indexing of the count of the hours display does not require a change in date when the display of a new time zone occurs, the only change in the display will result from the addition of a count of one to the timekeeping signal produced by the hours counter which change in count will be effected simultaneously with the selection of the adjacent global visual display segment.

However, when a change in time zone, of the type illustrated in FIGS. 3A and 3B, is effected, and the push button is actuated a sufficient number of times to index the global visual display segment from indicating Greenwich Mean Time to designating Tokyo time, the adder circuit 27 will continue to index the count of the timekeeping signal by one, and when the count thereof reaches twelve o'clock P.M., the adder circuit will index the count of the timekeeping signal produced by the date counter 25, by a count of one (1) in order to reflect the change of date. Accordingly, when necessary, a change of date will be illustrated by the digital display timepiece. This is particularly illustrated in FIG. 3B, wherein the time (9:21) and date (7) at Tokyo time are illustrated once the timepiece has been indexed from Greenwich Mean Time to Tokyo time.

As noted above, if push button 16 is actuated, when the crown is in a global select position, the up and down counter will count down, and cause the adder circuit 27 to remove a pulse from the timekeeping signals produced by the hours counter and, if necessary, a pulse from the timekeeping signal produced by the date counter, in response to each actuation of the push button 16. Thus, the time and date displayed by the numerical display digit will be changed simultaneously with the counterclockwise indexing of the global visual display segments 14. Accordingly, by the arrangement described above, a global electronic timepiece capable of displaying the time for each of the global time zones and being readily indexed between said time zones is provided.

Moreover, as is illustrated in FIG. 1, at least fifty-six display segments are required for displaying dates, hours and minutes for the twenty-four time zones, the number of display segments being even larger if display of seconds is to be effected. Since a lead wire must be provided for each display segment, considerable difficulties in manufacturing of the timepiece obtain when each of the respective lead wires is coupled to the output and input terminals of an IC chip. The instant invention is therefore characterized by the use of a multiplex drive circuit for driving the display elements. Specifically, two or more display digits are multiplexed at one time, and are multiplexed by the use of a synchronizing electrode. Thus, by utilizing a signal converter (not shown) between the decoder 20 and display portion 29, the number of lead wires can be reduced.

As noted above, the indexing arrangement is particularly characterized by the use of only two push buttons for indexing the up and down counter 26 to effect either a clockwise or counterclockwise indexing of the global visual display segments. Although such an arrrangement is particularly desirable, since the push buttons utilized for effecting correction of the timekeeping counters, can further be utilized to effect such indexing, the instant invention is clearly not so limited. For example, the push button 15 could be utilized to index by one the time zones in a clockwise direction, and the push button 16 could be utilized to index the time zones by a count of three for each actuation thereof in either a clockwise or counterclockwise direction.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A digital display for an electronic timepiece, electronic timekeeping circuit means for producing timekeeping signals representative of actual time and a particular time zone, decoder and driver means for receiving said timekeeping signals and producing timekeeping driving signals and time zone driving signals, comprising in combination a plurality of numerical display digits for displaying time information in response to said timekeeping driving signals being applied thereto, a plurality of visual indication display segments peripherally disposed about said numerical display digits, each of said indication display segments being selectively rendered visually distinguishable in response to said time zone driving signal being applied thereto, a time zone corresponding to the time displayed by said numerical display digits and a plurality of indicia peripherally disposed about said visual indication display segments, each said indicia being associated with a visual indication display segment and identifying a particular time zone.

2. A digital display as claimed in claim 1, wherein said display digits and said visual indication display segments are liquid crystal display cells.

3. In an electronic timepiece including divider means for producing a low frequency timing signal, series-connected counter means coupled to said divider means, each of said series-connected counter means being adapted to produce at least one timekeeping signal representative of the count of said counter means, driver means adapted to receive timekeeping signals representative of a count and in response thereto produce time display signals representative of the count of said timekeeping signals applied thereto, and digital display means for displaying time information corresponding to the count of the time display signals, the improvement comprising indexing means disposed intermediate at least one predetermined counter means and said driver means for selectively indexing the count of said timekeeping signal produced by said at least one predetermined counter means, said indexing means including adder means settable to a predetermined count disposed intermediate said driver means and said predetermined counter means for changing the count of said timekeeping signal produced by said predetermined timekeeping counter means by said predetermined count, said indexing means further including manually indexable up and down counter means coupled to said adder means for selectively applying to said adder means a count signal, to selectively change the count of said timekeeping signals applied thereto by said predetermined count of said count signal, said indexing means further including at least two manually operated switch means, said first manually operated switch means being operatively coupled to said up and down counter means to thereby increase by one the count of said counter means in response to each actuation of said first manually operated switch means, said second manually operated switch means being coupled to said up and down counter means to reduce the count of said up and down counter means by a count of one in response to each actuation of said second manually operated switch means.

4. An electronic timepiece as claimed in claim 1, wherein said adder means is adapted to add or subtract a predetermined count to said timekeeping signal applied thereto.

5. An electronic timepiece as claimed in claim 1, wherein said predetermined counter means is an hours counter means, said hours counter means being adapted to apply at least one timekeeping signal to said adder means.

6. An electronic timepiece as claimed in claim 5, wherein said hours counter means is adapted to count therein a counting cycle, and a further counter means is a date counter means, said date counter means being adapted to apply to said adder means a date timekeeping signal representative of the date of said date counter means, said adder means being adapted to index the count of said data signal, when the count of said hours signal is indexed between the end of a counting cycle of said hours counter means and the beginning of the counting cycle of said hours counter means.

7. An electronic timepiece as claimed in claim 1, wherein said digital display means includes further visual indication means for designating the amount of each indexing of the count of said predetermined timekeeping signal in response to an indexing drive signal being applied thereto, said up and down counter means being adapted to produce an indexing drive signal representative of the change in the count of said up and down counter means in response to each actuation thereof.

8. An electronic timepiece as claimed in claim 7, wherein said visual indication means are peripherally disposed around said digital display means and are adapted to be indexed in a clockwise direction in response to each indexing drive signal produced in response to an actuation of said first manually actuated switch means, said visual indication means being further adapted to be indexed in a counterclockwise direction in response to each of said indexing drive signals produced in response to the actuation of said second manually operated switch means.

9. An electronic timepiece as claimed in claim 7, and including switch control means for further coupling said first and second manually operated switch means to certain of said series-connected counter means, said control switch means being selectively disposable between at least a first time zone selection mode wherein said first and second manually operated switch means are coupled to said up and down counter means for selectively applying said indexing signal thereto, and a correction mode wherein said first and second manually actuated switch means effect the selective correction of the time counted by said respective counter means.

10. An electronic timepiece as claimed in claim 9, wherein said switch control means includes a further manually operated switch coordinately displacable between at least a time zone select position and a correction position for respectively disposing said switch control means in one of a time zone select mode and a correction mode.

11. An electronic timepiece as claimed in claim 1, wherein said series-connected counter means includes at least minute counter means for producing minutes timekeeping signals and hours counter means for producing hours timekeeping signals, said adder means being disposed intermediate said hours counter means and said driver means for selectively indexing the count of said hours timekeeping signal by said predetermined count.

12. An electronic timepiece as claimed in claim 11, wherein said indexing means is further adapted to apply an indexing signal to said driver means, said driver means in response to said indexing signal being adapted to apply to said digital display means an indexing drive signal to effect a further display indication of the indexing of the count of said hours timekeeping signals.

13. An electronic timepiece as claimed in claim 12, wherein said digital display means includes a plurality of numerical display digits for receiving said minute and hours drive signals and displaying a time representative of the count thereof, and a plurality of visual display segments adapted in response to said indexing drive signal to display an indexing of the count of said hours timekeeping signal.

14. An electronic tiempiece as claimed in claim 13, wherein the number of said visual display segments is twenty-four, said visual display segments being peripherally disposed around said numerical display digits.

15. An electronic timepiece as claimed in claim 14, wherein indicia means are disposed adjacent each of said display segments to identify a time zone indicated thereby.

16. An electronic timepiece as claimed in claim 1, wherein said digital display means includes at least hours display digits and minutes display digits and including multiplexing drive means for selectively multiplexing the timekeeping signals applied thereto to thereby effect a multiplexed drive of said hours display digits and minutes display digits.

17. An electronic timepiece as claimed in claim 1, wherein said digital display means includes a plurality of numerical display digits for displaying time information, and a plurality of further visual indication display segments for visually displaying when the timekeeping signal produced by said predetermined counter means is indexed.

18. An electronic timepiece as claimd in claim 17, wherein said plurality of visual display elements includes twenty-four (24) display segments peripherally disposed around said numerical display digits, said indexing means being adapted to apply to said drive means an indexing signal to index said visual display segment adjacent to the segment energized prior to the count of said timekeeping signal being indexed by a count of one.

19. An electronic timepiece as claimed in claim 17, and including multiplexing drive means for selectively multiplexing the timekeeping signals applied thereto to thereby effect a multiplex drive of said plurality of numerical display digits for displaying time information, and said plurality of further visual indication display segments for visually displaying when the timekeeping signal, produced by said predetermined counter means, is indexed.

20. In an electronic timepiece including divider means for producing a low frequency timing signal, series-connected counter means coupled to said divider means, each of said series-connected counter means being adapted to produce at least one timekeeping signal representative of the count of said counter means, driver means adapted to receive timekeeping signals representative of a count and in response thereto produce time display signals representative of the count of said timekeeping signals applied thereto, and digital display means for displaying time information corresponding to the count of the time display signals, the improvement comprising indexing means disposed intermediate at least one predetermined counter means that produces timekeeping signals representative of hours and said drive means for selectively indexing the count of said hours timekeeping signal, said indexing means including adder means settable to a predetermined count disposed intermediate said driver means and said predetermined counter means for changing the count of said hours timekeeping signal by said predetermined count, said indexing means further including manually indexable up and down counter means coupled to said adder means for selectively applying to said adder means a count signal, to selectively change the count of said timekeeping signals applied thereto by said predetermined count of said count signal, said digital display means including a numerical display digit for receiving said hours timekeeping signals and timekeeping signals representative of minutes and displaying a hours and minutes time representative of the count thereof, and a plurality of visual display segments adapted in response to said indexing drive signal to display an indexing of the count of said hours timekeeping signal, said visual display segments being peripherally disposed around said numerical display digit.

21. An electronic timepiece as claimed in claim 20, wherein said indexing means further includes at least two manually operated switch means, said first manually operated switch means being operatively coupled to said up and down counter means to thereby increase by one the count of said counter means in response to each actuation of said first manually operated switch means, said second manually operated switch means being coupled to said up and down counter means to reduce the count of said up and down counter means by a count of one in response to each actuation of said second manually operated switch means.

22. An electronic timepiece as claimed in claim 21, wherein said visual indication means are peripherally disposed around said digital display means and are adapted to be indexed in a clockwise direction in response to each indexing drive signal produced in response to an actuation of said first manually actuated switch means, said visual indication means being further adapted to be indexed in a counterclockwise direction in response to each of said indexing drive signals produced in response to the actuation of said second manually operated switch means.

* * * * *